US009770146B2

(12) United States Patent
Fingleton et al.

(10) Patent No.: US 9,770,146 B2
(45) Date of Patent: Sep. 26, 2017

(54) VACUUM APPARATUS

(75) Inventors: Henry Joseph Fingleton, Portlaoise (IE); Dermot Thomas Costello, Portlaoise (IE)

(73) Assignee: Sweepovac Limited, Portlaoise (IE)

( * ) Notice: Subject to any disclaimer, the term of this patent is extended or adjusted under 35 U.S.C. 154(b) by 1165 days.

(21) Appl. No.: 13/988,396

(22) PCT Filed: Dec. 7, 2011

(86) PCT No.: PCT/IE2011/000065

§ 371 (c)(1),
(2), (4) Date: May 20, 2013

(87) PCT Pub. No.: WO2012/077095

PCT Pub. Date: Jun. 14, 2012

(65) Prior Publication Data

US 2013/0291899 A1 Nov. 7, 2013

(30) Foreign Application Priority Data

Dec. 7, 2010 (IE) ..... S2010/0765
Jul. 28, 2011 (IE) ..... S2011/0335

(51) Int. Cl.
*A47L 5/38* (2006.01)
*A47L 5/28* (2006.01)
(Continued)

(52) U.S. Cl.
CPC *A47L 5/38* (2013.01); *A47L 5/22* (2013.01); *A47L 5/28* (2013.01); *A47L 9/00* (2013.01); *A47L 5/32* (2013.01)

(58) Field of Classification Search
CPC ..... A47L 5/32; A47L 5/28; A47L 9/00; A47L 5/38
(Continued)

(56) References Cited

U.S. PATENT DOCUMENTS 3,744,653 A * 7/1973 Jensen ..... E01H 1/0836 15/340.1
5,138,742 A * 8/1992 Charky ..... A47L 5/22 15/340.1
(Continued)

FOREIGN PATENT DOCUMENTS

DE 10135470 A1 2/2003
EP 1205141 A2 5/2002

OTHER PUBLICATIONS

Int'l. Search Report for corresponding PCT patent application No. PCT/IE2011/000065 filed Dec. 7, 2011 and published as WO 2012/077095 A1 on Jun. 14, 2012, and all references cited therein.

*Primary Examiner* — Michael Jennings
(74) *Attorney, Agent, or Firm* — Olive Law Group, PLLC

(57) ABSTRACT

A self-contained vacuum apparatus having a housing with an air inlet aperture for receiving debris, a dustbag in the housing communicable with the air inlet for storing received debris, a suction motor communicable with the air inlet aperture for generating suction at the aperture to draw the debris into the dustbag, an air outlet aperture communicable with the suction motor to exhaust air from the vacuum apparatus, and an on/off switch for activating the vacuum apparatus, the vacuum apparatus being mountable in a cavity to locate the air inlet aperture adjacent a floor surface so that debris urged towards the air inlet aperture is drawn into the dustbag upon activation of the on/off switch.

13 Claims, 15 Drawing Sheets

(51) Int. Cl.
*A47L 5/22* (2006.01)
*A47L 9/00* (2006.01)
*A47L 5/32* (2006.01)

(58) Field of Classification Search
USPC ..... 15/340.1, 352, 354; 56/13.2, 16.6
See application file for complete search history.

(56) References Cited

U.S. PATENT DOCUMENTS 6,101,666 A * 8/2000 Cheng ..... A47L 7/0047 15/301
6,108,858 A * 8/2000 Smith ..... A47L 5/38 15/301
6,286,177 B1 * 9/2001 Robinson ..... A47L 5/38 15/301
6,671,924 B1 * 1/2004 Rood ..... A47L 13/52 15/301
6,928,691 B2 * 8/2005 Freeman ..... A47L 7/0047 15/310
7,578,024 B2 * 8/2009 Hughes ..... B65F 1/06 15/310
2006/0117519 A1 * 6/2006 Bock ..... A47L 9/1409 15/347
2007/0151067 A1 * 7/2007 Cheng ..... A47L 7/0047 15/310
2011/0214567 A1 * 9/2011 McClearen ..... A47L 9/00 95/273

* cited by examiner

VACUUM APPARATUS

CROSS REFERENCE TO RELATED APPLICATION

This application is a 35 USC 371 application of International PCT Patent Application No. PCT/IE2011/000065, filed on Dec. 7, 2011, and further claims priority to Ireland Patent IE S2010/0765, filed Dec. 7, 2010, and Ireland Patent IE S2011/0335, filed Jul. 28, 2011; the entire contents of which are hereby incorporated by reference herein in their entireties.

INTRODUCTION

This invention relates to a vacuum apparatus and more particularly to a self-contained vacuum apparatus for cleaning floors.

BACKGROUND OF THE INVENTION

Difficulties can be encountered in removing dust, debris and dirt from floors which are intensively used such as domestic floors and commercial floors. For example, elderly people and the disabled can encounter difficulties in bending and sweeping when cleaning domestic floors manually while considerable quantities of debris can accumulate in industrial and retail environments such as the food preparation, hairdressing and wood/metalwork industries.

In general, vacuum cleaners have been employed both domestically and commercially to remove dirt from floors. However, known vacuum cleaners suffer from a number of disadvantages. For example, known portable vacuum cleaners can be cumbersome to use—especially in confined domestic spaces and can still present difficulties to mobility impaired users when lifting and manoeuvring the vacuum cleaners. Central vacuum systems are also used for cleaning purposes. However, such vacuum systems are expensive to install and can still present difficulties in use—particularly to the mobility impaired. Moreover, central vacuum systems are difficult and prohibitively expensive to retrofit whilst causing severe disruption during the retrofitting process.

SUMMARY OF THE INVENTION

According to the invention, there is provided a self-contained vacuum apparatus comprising:

- a housing having an air inlet aperture for receiving debris;
- a storage means in the housing communicable with the air inlet for storing received debris;
- a suction means communicable with the air inlet aperture for generating suction at the aperture to draw the debris into the storage means,
- an air outlet aperture communicable with the suction means to exhaust air from the vacuum apparatus, and
- an on/off switch for activating the vacuum apparatus, the housing being mountable in a cavity to locate the air inlet aperture adjacent a floor surface.

Preferably, the on/off switch comprises a kicker switch. Alternatively, the on/off switch comprises a sensor switch. Suitably, the sensor switch is selected from the group comprising an IR sensor switch, an electronic sensor switch or a magnetic sensor switch.

Preferably, the storage means comprises a storage cradle removeably mounted in the housing. More preferably, the storage means further comprises a dustbag removeably mounted in the cradle. Alternatively, storage means further comprises a bagless container removeably mounted in the cradle.

Suitably, the suction means comprises a suction motor. The suction means can comprise a pair of motors.

Preferably, the suction motor is housed in a motor chamber. More preferably, the motor chamber is disposed rearwardly of the storage means.

In one embodiment of the invention, the air outlet aperture is disposed linearly from air the inlet aperture so that the air inlet aperture and the air outlet aperture are in a linear relationship.

In another embodiment of the invention, the air outlet aperture is offset with respect to the air inlet aperture. Preferably, the air outlet aperture is offset with respect to the air inlet aperture by about 90° to exhaust air from the side of the vacuum apparatus.

Advantageously, the air inlet aperture is formed as part of a front head section removeably mounted on the housing, the air inlet aperture being fluidly communicable with the storage means through the front head section.

Preferably, the air inlet aperture is fluidly communicable with the storage means through a rearwardly extending duct in the front head section. More preferably, the air inlet aperture is fluidly communicable with the storage means through a bore in the front head section.

Suitably, the self-contained vacuum apparatus comprises a face plate mountable between the front head section and the housing. Preferably, the face plate comprises means for reversibly locking the vacuum apparatus in situ.

In a preferred embodiment of the invention the vacuum apparatus comprises adjustable stabilising means on the housing for securing vacuum apparatus in situ.

Suitably, a dirt filter is mounted between the storage means and the suction means.

Advantageously, the air inlet aperture, the housing, the storage means, the suction means and the air outlet aperture are arranged to define a low profile vacuum apparatus.

In a preferred embodiment of the invention, the housing is mountable in a cavity beneath a cabinet. More preferably, the cabinet is a kitchen cabinet.

The invention also extends to a method for removing debris from a floor surface comprising locating a self-contained vacuum apparatus as hereinbefore defined adjacent the floor surface, urging debris towards the apparatus and activating the apparatus to suck the debris into the apparatus.

More particularly, the invention also extends to a method for removing debris from a floor surface comprising locating a self-contained vacuum apparatus having

- a housing having an air inlet aperture for receiving debris,
- a storage means in the housing communicable with the air inlet for storing received debris;
- a suction means communicable with the air inlet aperture for generating suction at the aperture to draw the debris into the storage means, and
- an air outlet aperture communicable with the suction means to exhaust air from the vacuum apparatus, and
- an on/off switch for activating the vacuum apparatus, adjacent the floor surface, urging debris towards the air inlet aperture and activating the on/off switch to suck the debris into the storage means through the air inlet aperture.

Preferably, the on/off switch is activated by foot. Alternatively, the on/off switch is sensor operated.

In a preferred embodiment, the self-contained vacuum apparatus is located in a cavity beneath a cabinet. More preferably, the cabinet is a domestic kitchen cabinet.

The invention therefore provides a self-contained vacuum apparatus comprising a housing having an inlet aperture, a storage means for storing collected material, and a suction means for generating suction at the aperture. The self-contained vacuum apparatus has an air inlet aperture adapted for locating adjacent a floor surface such that the housing is contained within a wall or within or under another structure for example a skirting board or cupboard.

The housing comprises a rectangular container with a suction motor disposed rearwardly and linearly from the inlet aperture and a storage means disposed between the inlet aperture and the suction motor. In another preferred embodiment, the suction motor may not be arranged in a linear manner but may be arranged sideways of the inlet aperture.

The air inlet aperture is formed as part of a removable front head section. The front head section has a rearwardly projecting flange onto which a storage container for example a bag may be engaged.

The front head section is releasably engageable in the housing. In another embodiment of the invention, the front head section may not be completely removable but may be openable and may possibly be hinged to the main body.

The front head section may also be a friction or interference fit with the housing.

The housing can contain two side by side motors for producing suction at the inlet aperture. A single motor may be used if desired.

The front of the housing has a switch means for supplying power to the motors while the front head section preferably has a hood flange over the inlet aperture.

The inlet aperture has a curved front edge while in another preferred embodiment of the invention, the apparatus comprises a housing having a removable bottom cradle for supporting a storage bag. The bottom cradle has mounted thereon a front head section.

The suction motor is mounted within the housing, rearwardly of the bottom cradle. The suction motor is mounted in a conduit of a lower frame, transversely of the bottom cradle and suction is applied to the storage bag via an arcuate conduit. The arcuate conduit is curved through approximately 90°.

The top cover is engaged with the lower frame to enclose the suction motor and storage bag and to form the upper section of the arcuate conduit and the inlet aperture is formed as part of the front head section. The front head section has a mounting means onto which a storage bag can be engaged.

The front head section is releasably engageable in the housing and can also be a friction or interference fit with the housing while the front of the housing has a switch means for supplying power to the motor.

The vacuum apparatus of the invention provides an excellent solution for the ongoing problem of efficiently and effectively removing dirt and dust from areas in a cost effective manner. The vacuum apparatus has utility in commercial and industrial environments such as in the food preparation and hairdressing industries and in domestic dwellings—particularly kitchens. The vacuum apparatus is convenient, reliable and easy to use simply requiring the user to brush dirt and debris towards the air inlet aperture while the vacuum apparatus can be activated without requiring bending etc. The invention is of particular benefit to the elderly, the disabled and those with mobility problems. The invention also finds application in the removal of human and pet hairs etc in commercial environments.

The vacuum apparatus of the invention is compact and self-contained and can therefore be installed in confined spaces and retrofitted without giving rise to disruption, damage and high installation costs. Moreover, unlike centralised vacuum systems, the vacuum apparatus of the invention can be easily installed and/or retrofitted in multiple locations within a building in a cost-effective manner. In particular, in domestic kitchens and the like, the vacuum apparatus of the invention exploits the previously unutilised dead space to be found behind kicker boards and beneath cabinets Moreover, where the air outlet aperture of the vacuum apparatus of the invention is disposed to the side of the apparatus, the apparatus is not subject to depth restrictions in the cavity in which it is inserted—this is of particular value in a domestic applications where depth space can be at a premium and side space is more readily available beneath cabinets and the like. As indicated in the following description, the air outlet aperture can be oriented as required in accordance with the space saving requirements of the end use of the apparatus. For example, although an angle of 90° was found to be highly space saving and efficient, other angles can be employed as required.

BRIEF DESCRIPTION OF THE DRAWINGS

The invention will now be described, by way of example only, with reference to the accompanying drawings in which.

DETAILED DESCRIPTION OF THE INVENTION

Figure 1:
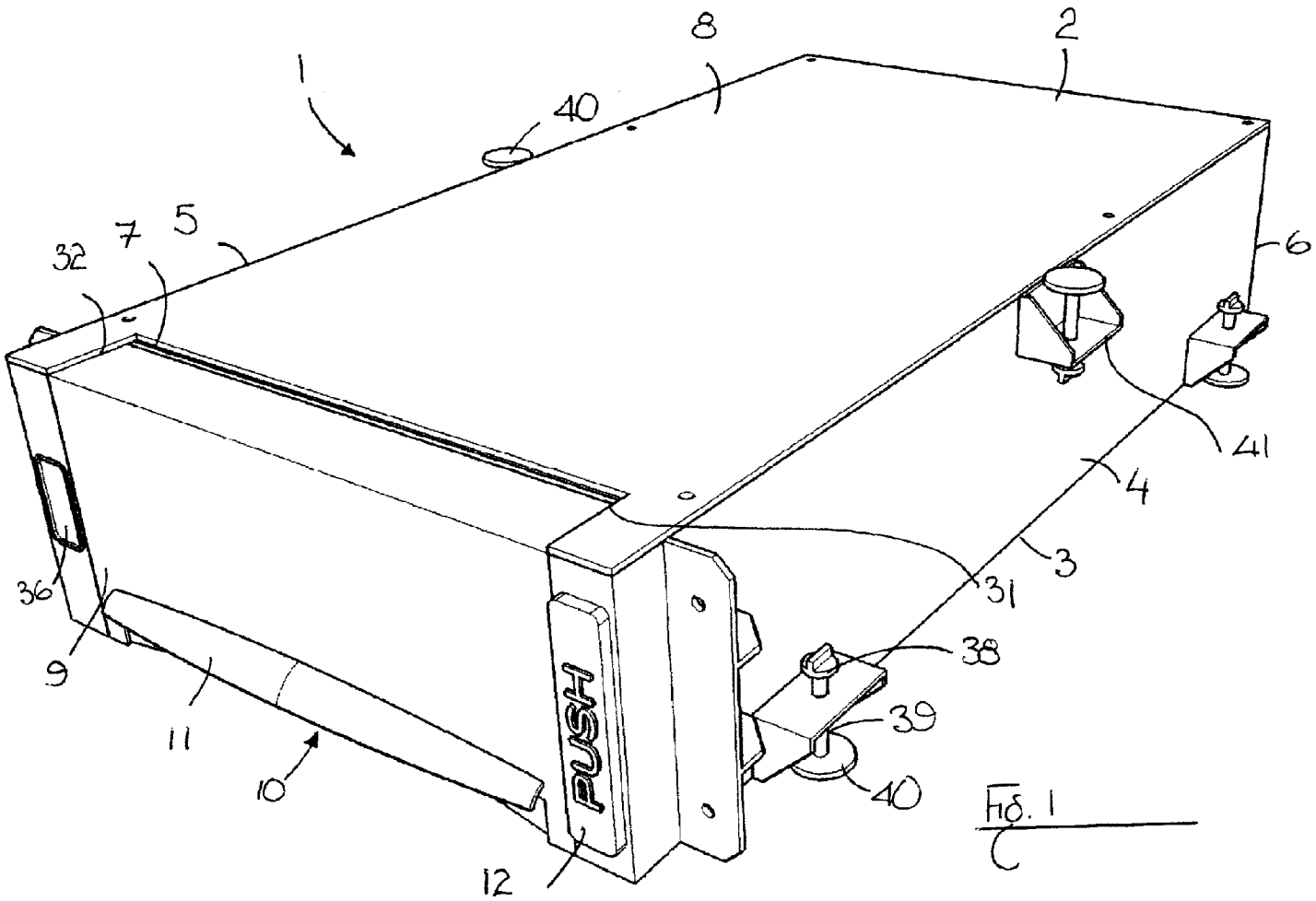
FIG. 1 is a perspective view from above and one side of a first embodiment of a self-contained vacuum apparatus for cleaning floors of the invention in which the vacuum apparatus is fitted with a double suction motor.

FIGS. 1 to 5 show a first embodiment of a low-profile and compact self-contained or standalone vacuum apparatus of the invention generally indicated by the reference numeral 1 suitable for installation at floor-level so that dirt urged towards the vacuum apparatus can be sucked into and stored by the vacuum apparatus. In the following description, reference is made to a domestic installation and use of the vacuum apparatus. However, as indicated above, the vacuum apparatus of the invention is suitable for use in domestic, commercial and industrial environments. Moreover, the vacuum apparatus of the invention can be specifically adapted for use in such environments if desired.

As shown in FIGS. 1 to 5, the self-contained vacuum apparatus 1 is made up of an external shell or housing 2 having a bottom wall 3, first and second side walls 4,5 respectively upstanding from the bottom wall 3 and front and rear walls 6,7 respectively also upstanding from the bottom wall 3. The housing 2 is fitted with a removeable top cover 8 secured to the first and second side wall 4,5 respectively and the rear and front wall 7,8 respectively.

It will be appreciated by those skilled in the art that the vacuum apparatus 1 of the invention can be dimensioned in accordance with the intended application. For example, for the purposes of the present embodiment where the vacuum apparatus 1 is for use in a kitchen and installed behind a kicker board, the housing typically has a depth of about 450 mm, a width of about 240 mm and a height of about 97 mm. Accordingly, the height of the housing 2 is less than 50% of the width of the housing so that the vacuum apparatus 1 is a compact low profile housing that can be accommodated in the kicker board or elsewhere in a domestic dwelling such as under a cabinet, in a skirting board or indeed in a wall.

A detachable front head section 9 is mounted at the front wall 7. Where the vacuum apparatus is installed in a kicker board, the front head section typically lies substantially flush with the kicker board. The front head section 9 is provided with an arcuate air/dust inlet aperture 10 at floor level for sucking air, dust and debris into the vacuum apparatus 1. The inlet aperture 10 is defined in the front head section 9 beneath an overhanging grippable hood 11. As shall be explained more fully below, the hood 11 can be gripped by a user to remove the detachable front dead section 9 from the housing 2.

As shall be explained more fully below, a depressable on/off kick switch 12 is provided adjacent front head section 9 to provide electrical power to the vacuum apparatus 1. The on/off kick switch 12 can be operated by foot so that it is unnecessary for a user to bend to operate the vacuum apparatus 1.

Figure 2:
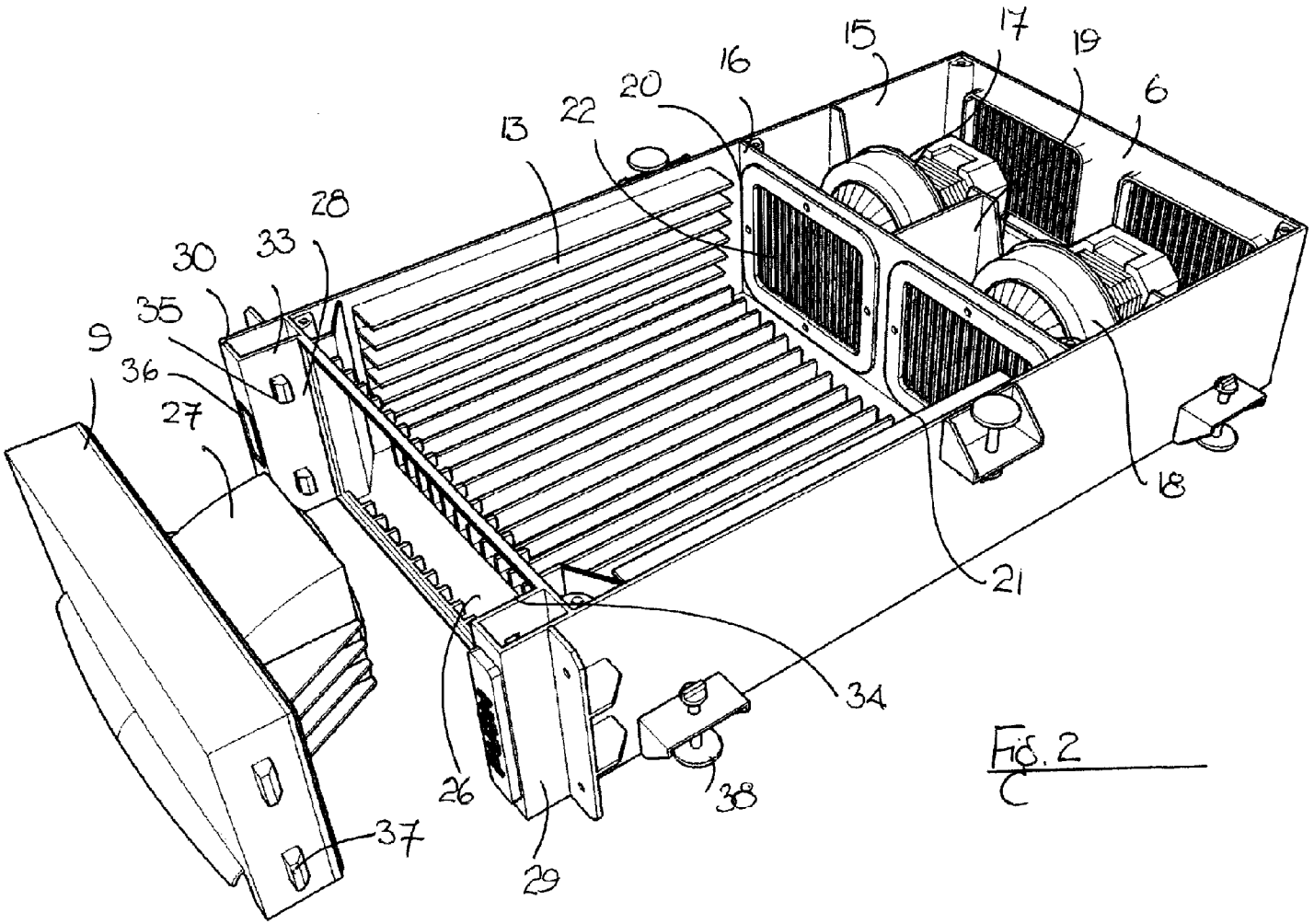
FIG. 2 is a perspective view from the front, above and one side of the self-contained vacuum apparatus of FIG. 1 with the front head section removed and the top cover removed to show the interior of the vacuum apparatus.
Figure 3:
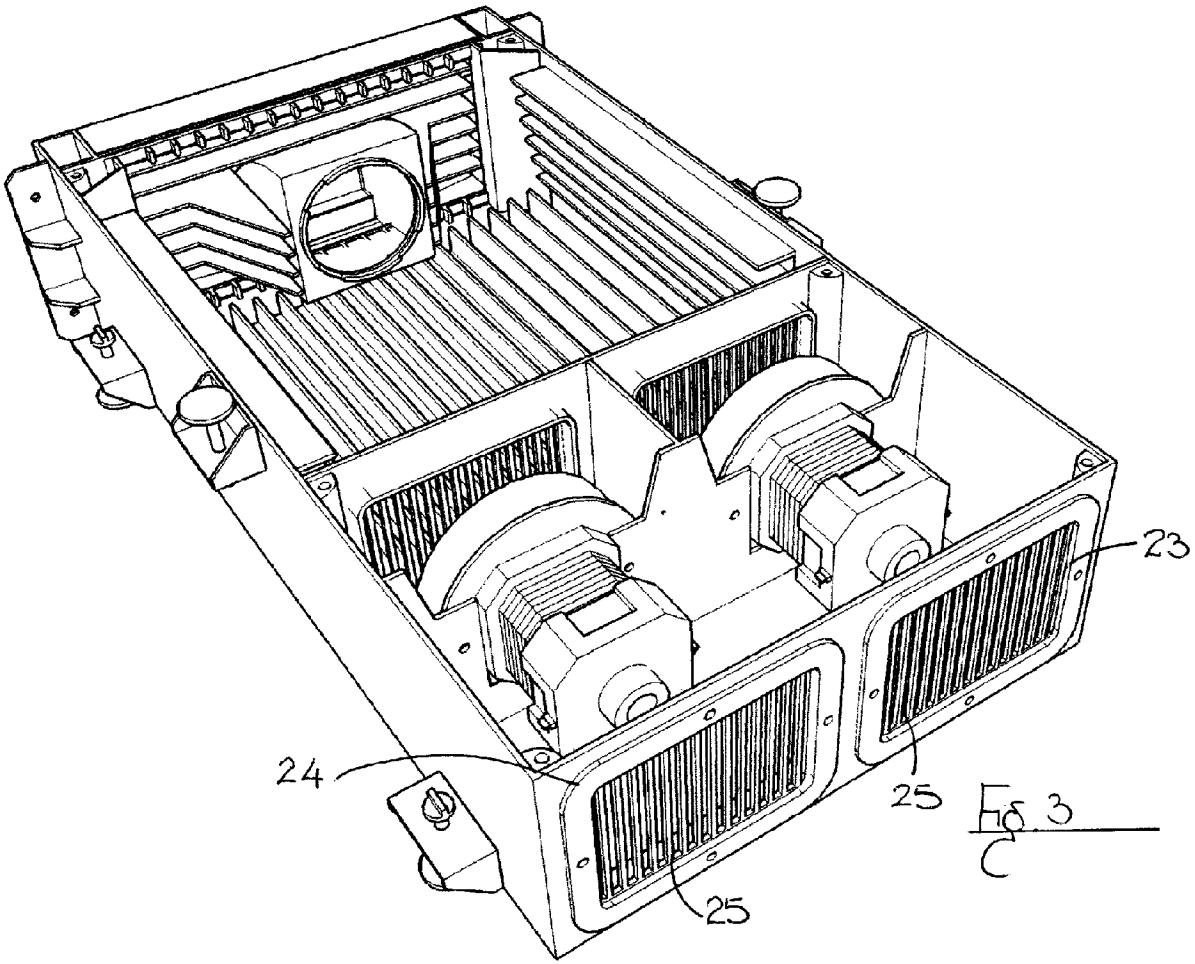
FIG. 3 is perspective view from the rear, above and one side of the vacuum apparatus of FIG. 1 with the top cover removed and the front head section in place.
Figure 4:
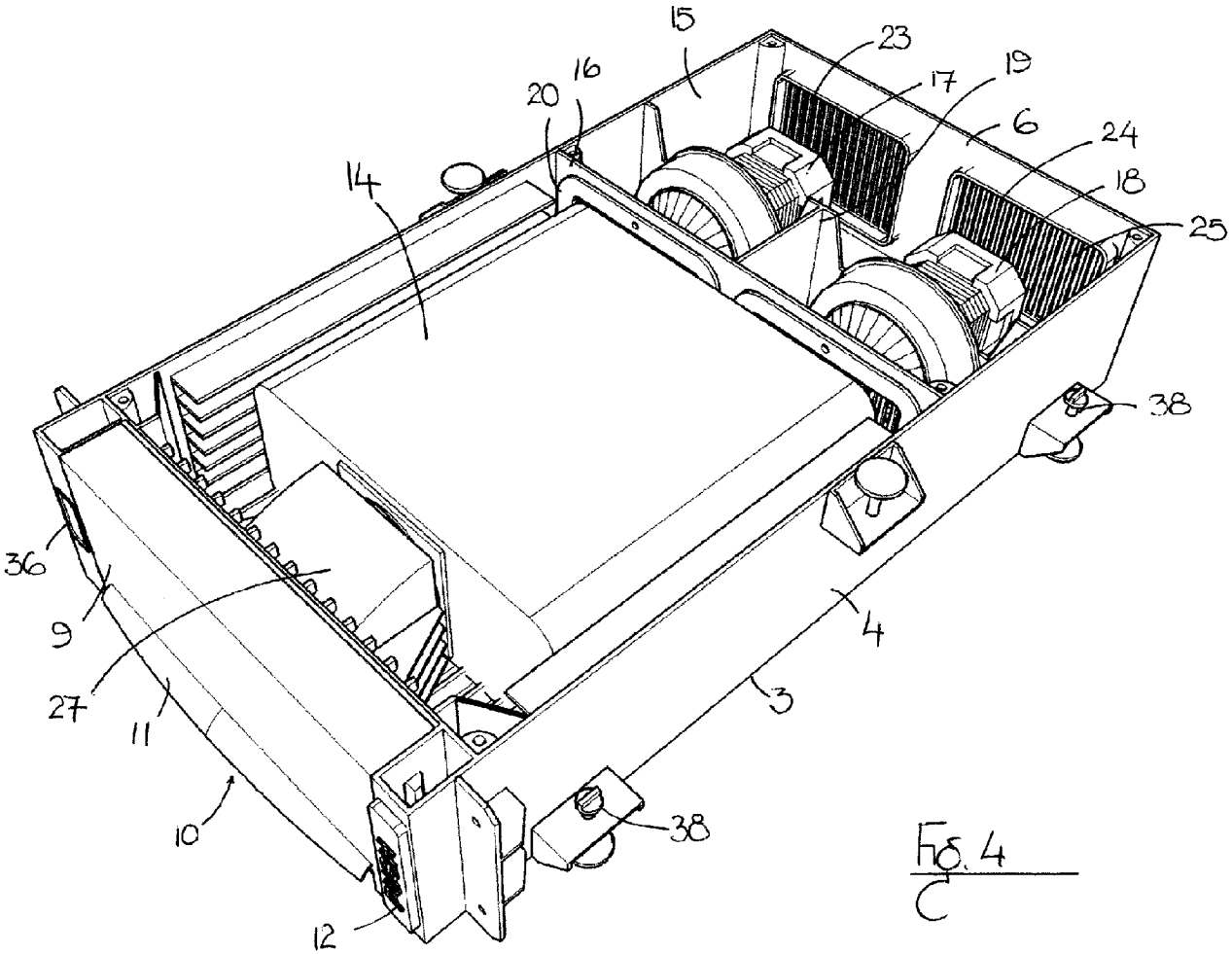
FIG. 4 is a perspective view from above and one side of the vacuum apparatus with the top cover removed and a dust collecting bag installed in the vacuum apparatus.
Figure 5:
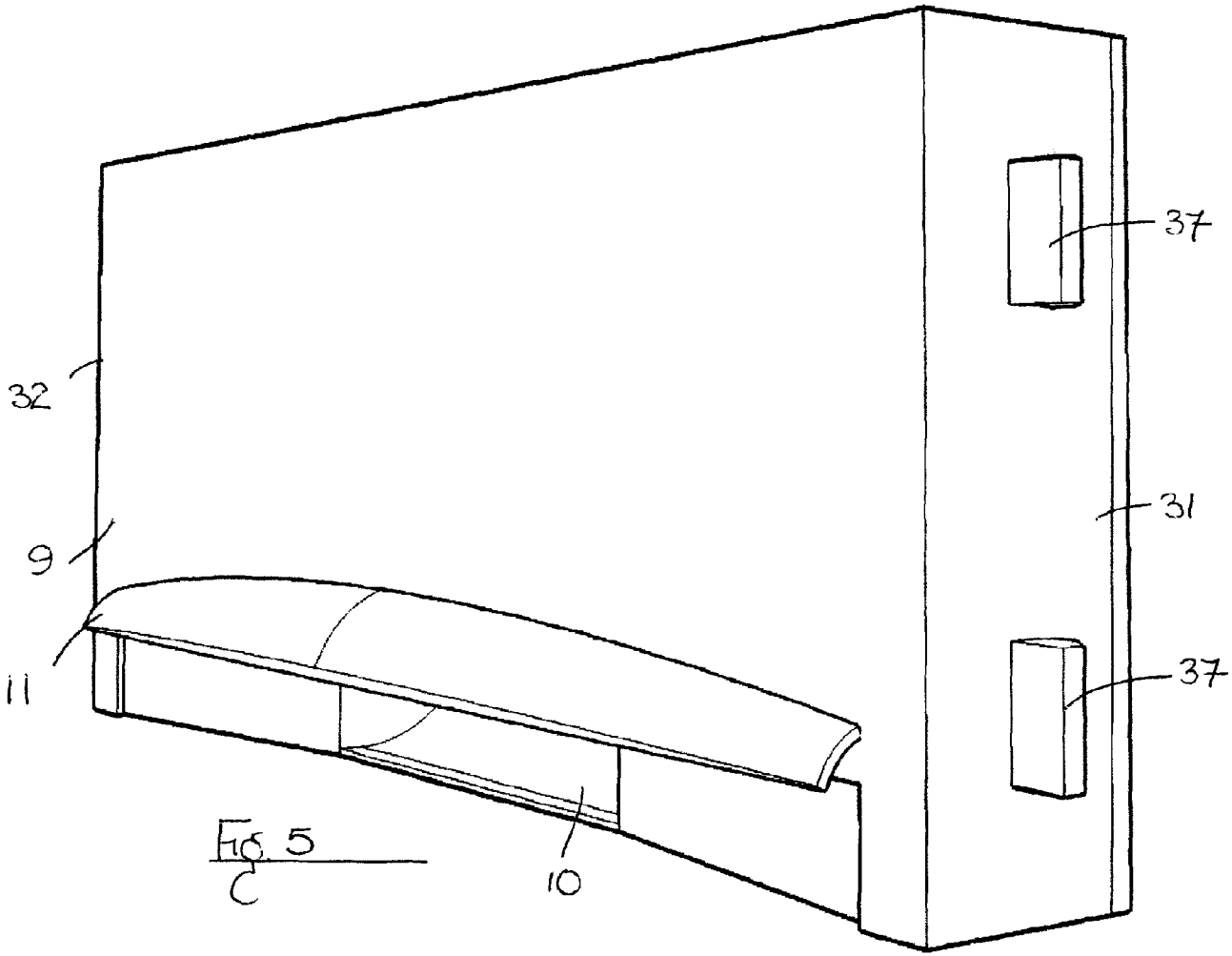
FIG. 5 is an enlarged front perspective view from one side of the front head section of the apparatus.
Figure 6:
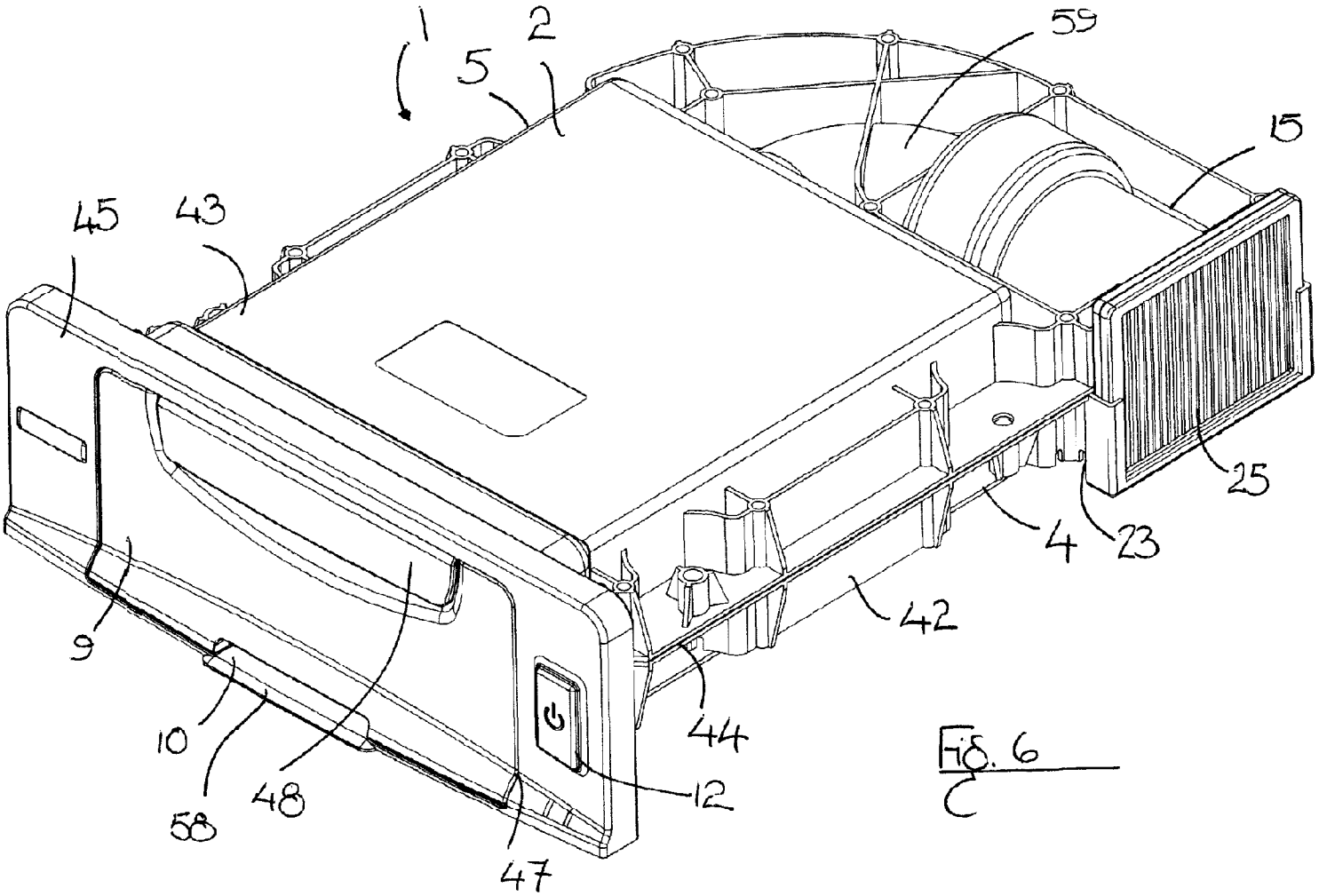
FIG. 6 is a perspective view from above and one side of a second embodiment of the self-contained vacuum apparatus of the invention in which the vacuum apparatus is provided with a single suction motor located in an arcuate conduit so that that the vacuum apparatus vents air from its side.
Figure 7:
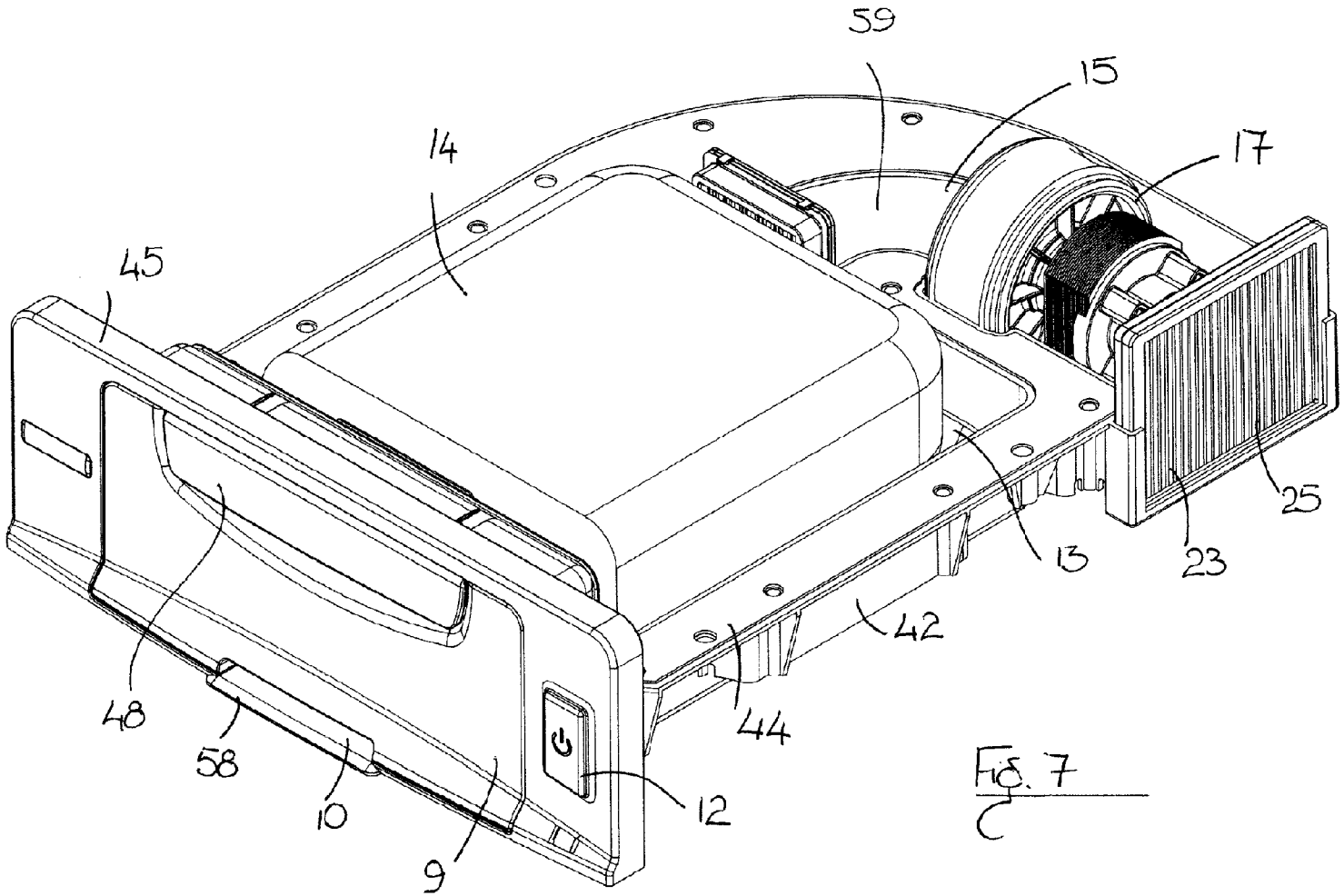
FIG. 7 is a front perspective view from above and one side of the vacuum apparatus of FIG. 6 with the top shell of the housing removed to show the bag in the vacuum apparatus in the lower shell.
Figure 8:
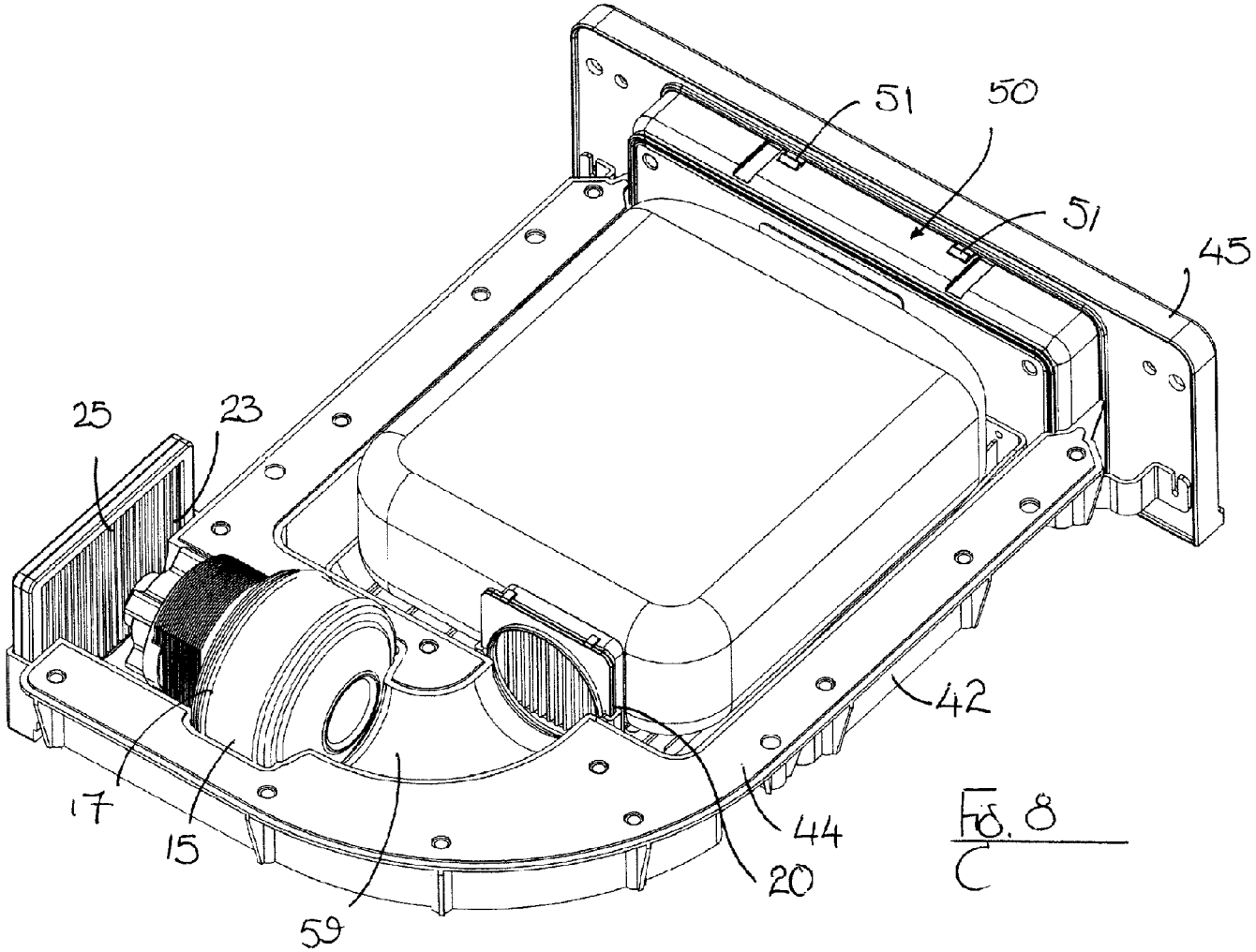
FIG. 8 is a rear perspective view from above and one side of the vacuum apparatus of FIG. 7.
Figure 9:
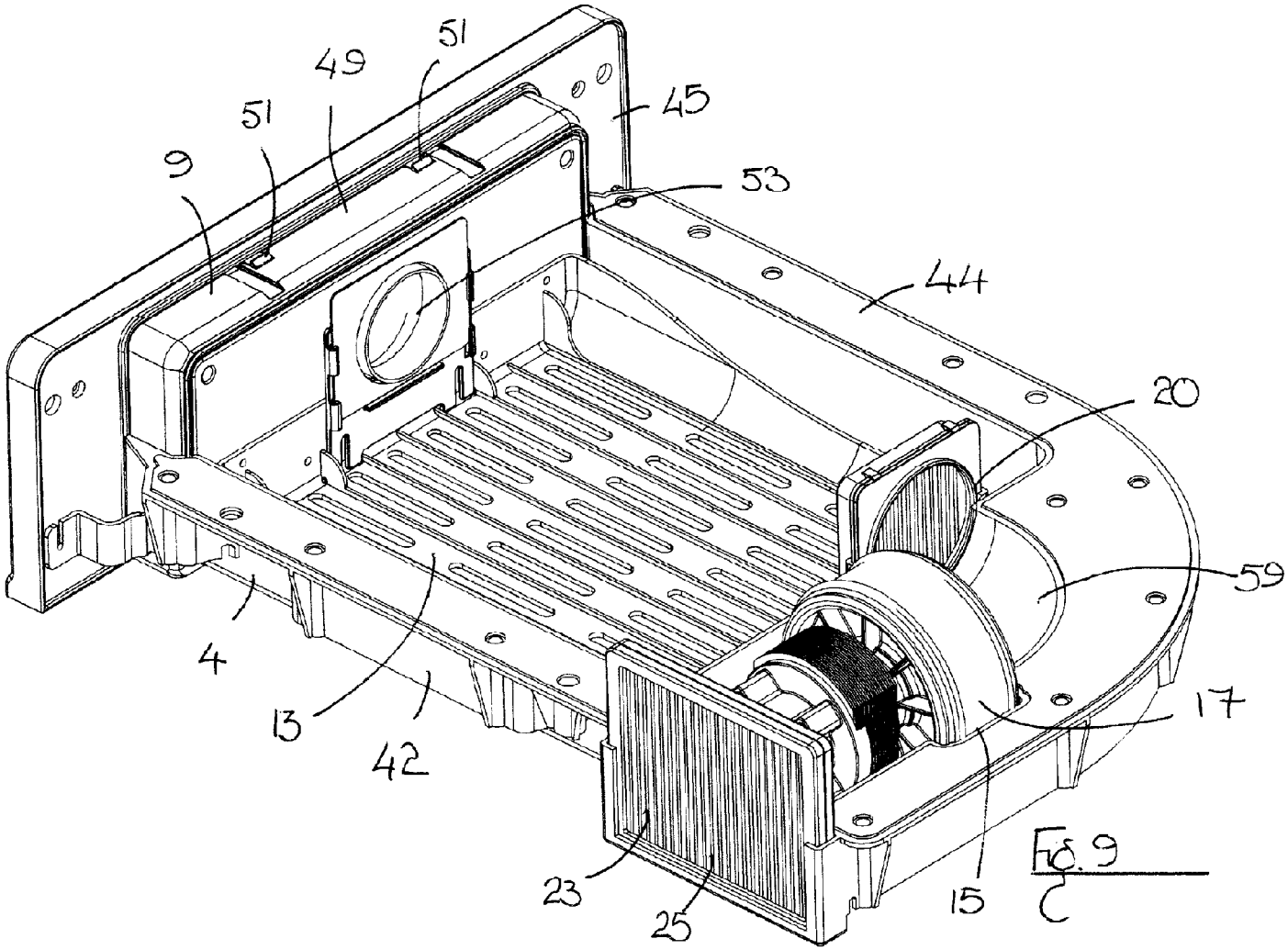
FIG. 9 is a rear perspective view from above and the opposite side of the vacuum apparatus of FIG. 8 with the bag removed to show the bag cradle in the lower shell of the housing.
Figure 10:
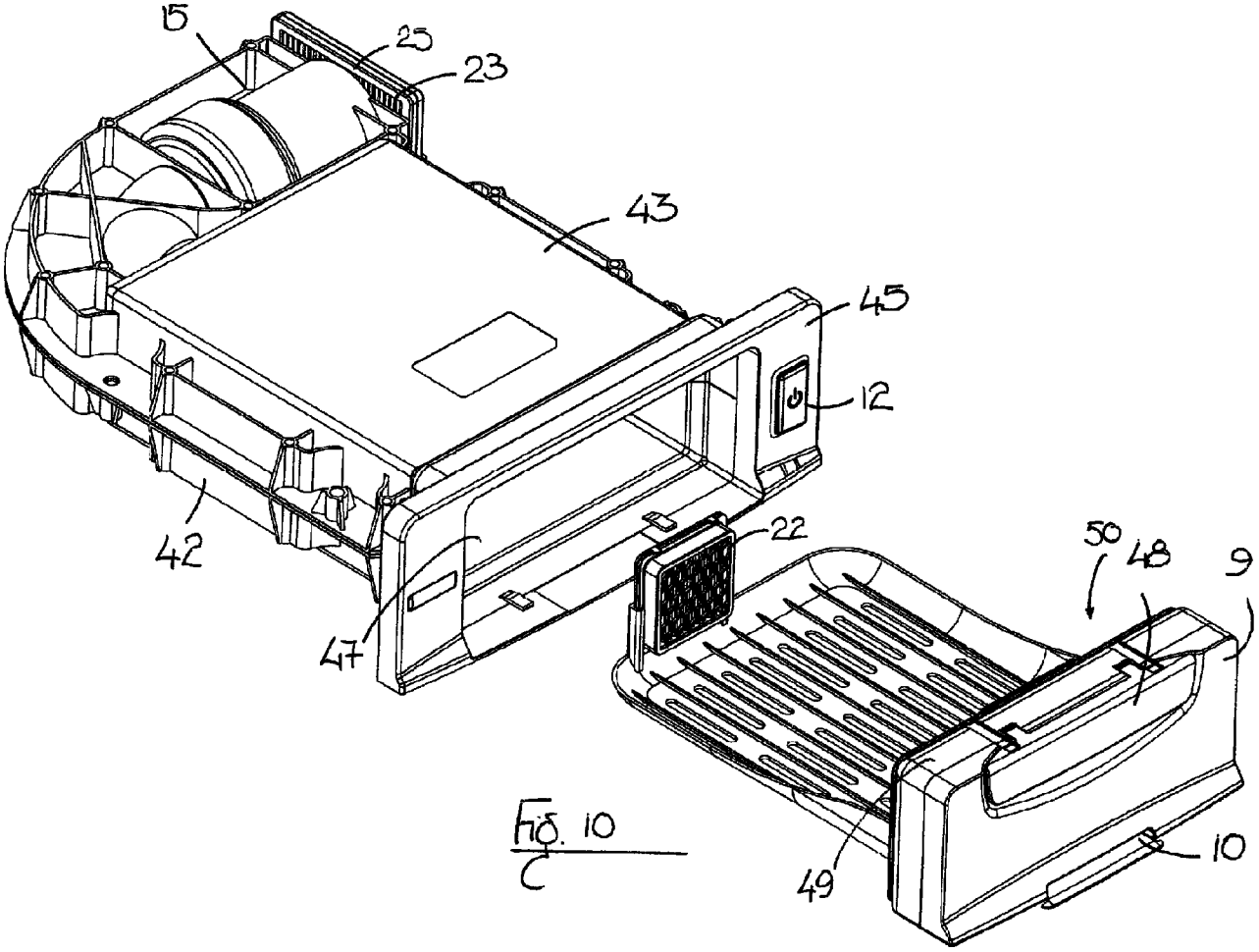
FIG. 10 is a front perspective view from above and one side the vacuum apparatus of FIG. 6 with the bag cradle and bag filter removed from the vacuum apparatus.
Figure 11:
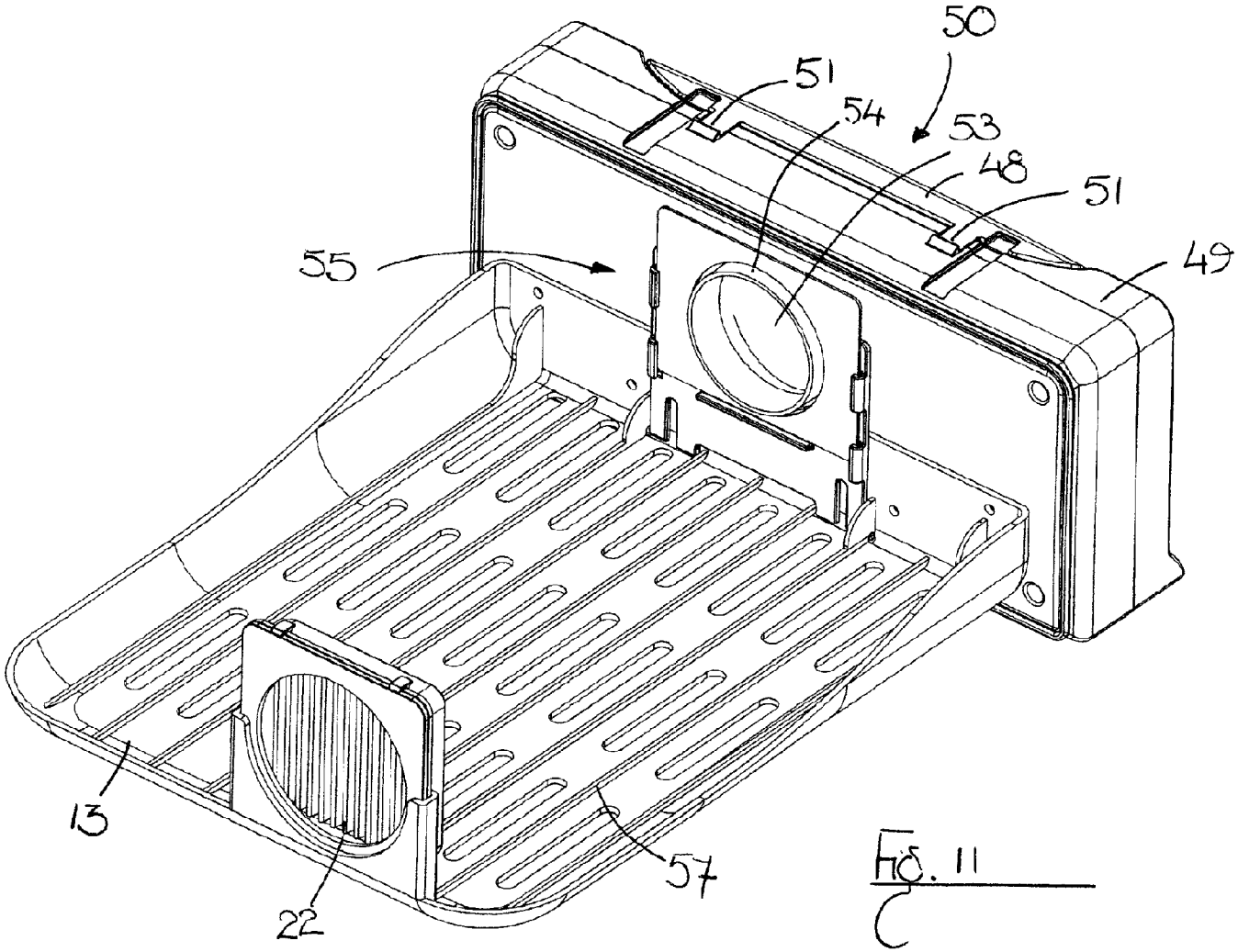
FIG. 11 is an enlarged rear perspective view from above and one side of the bag cradle of FIG. 10.
Figure 12:
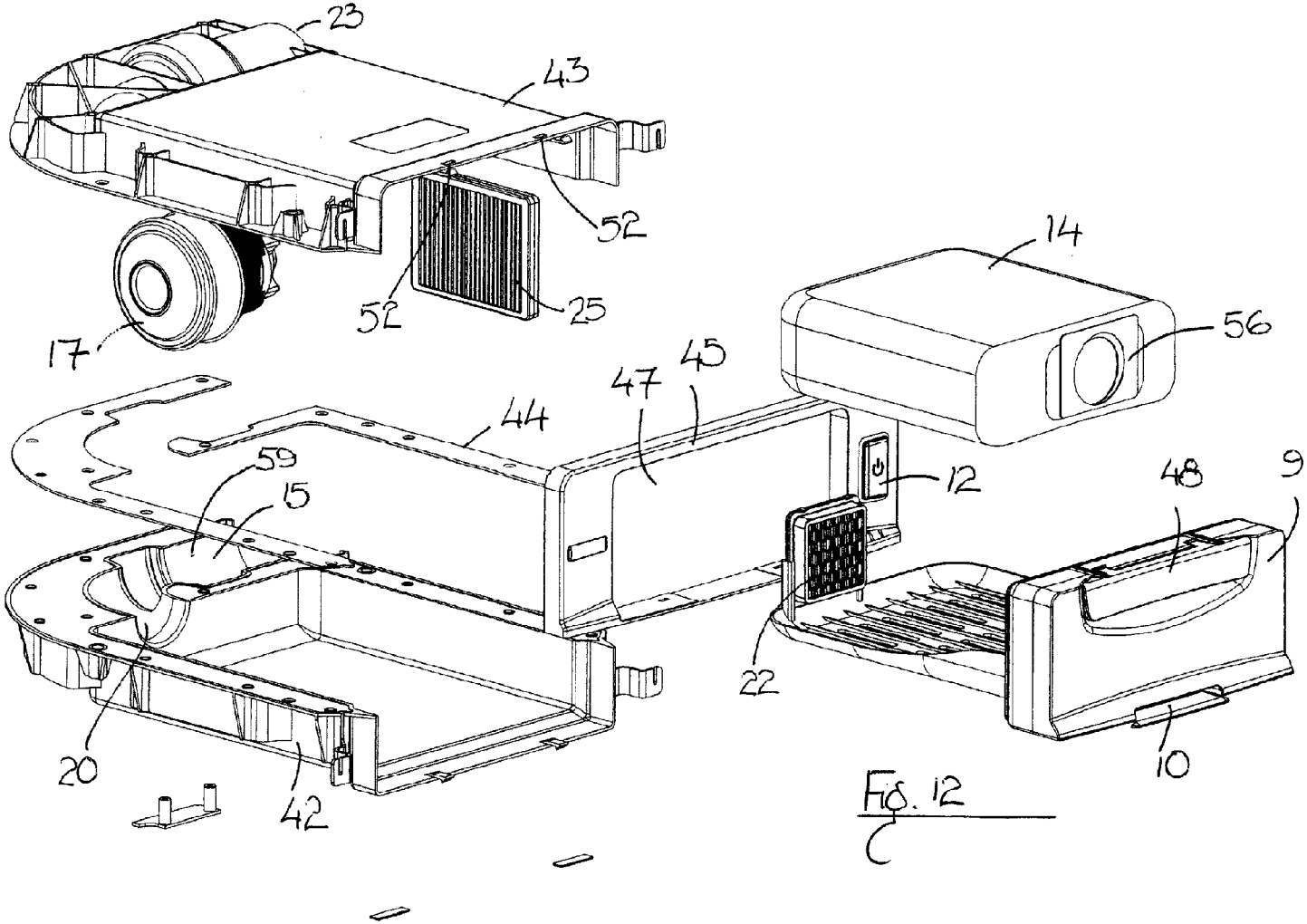
FIG. 12 is an exploded front perspective view from above and one side of the vacuum apparatus of FIG. 6.
Figure 13:
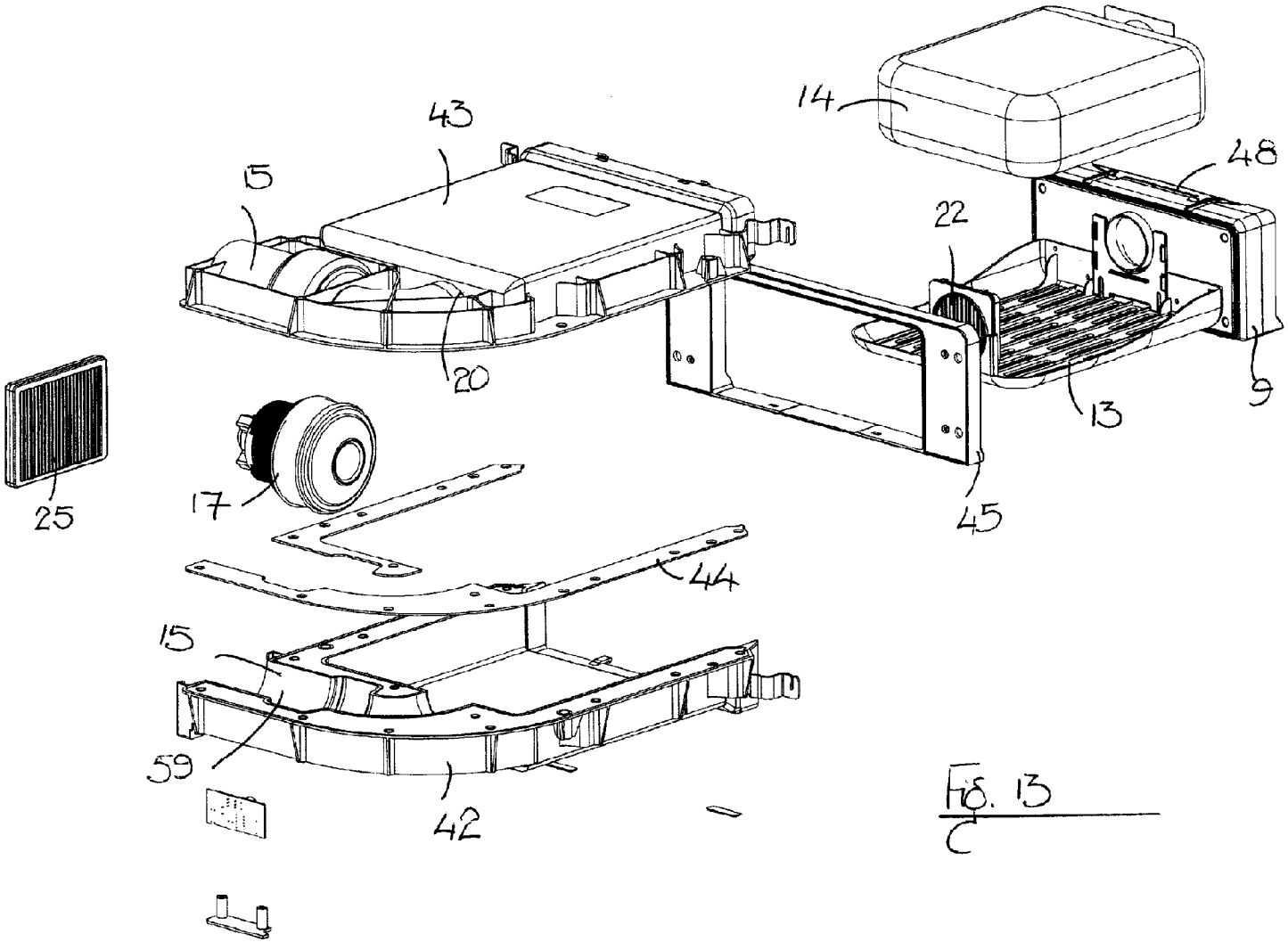
FIG. 13 is an exploded rear perspective view from above and one side of the vacuum apparatus of FIG. 6.
Figure 14:
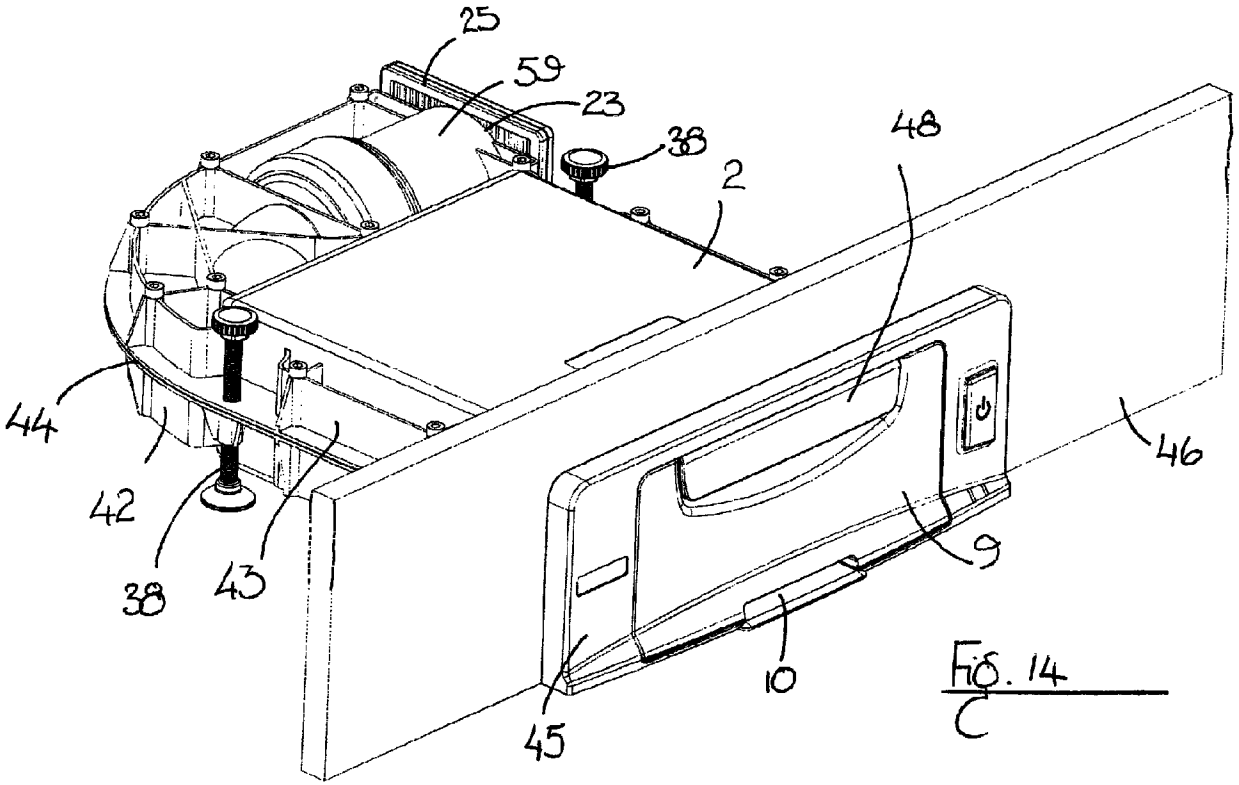
FIG. 14 is front perspective view from above and one side of the vacuum apparatus of FIG. 6 mounted in-situ at a domestic kicker board.
Figure 15:
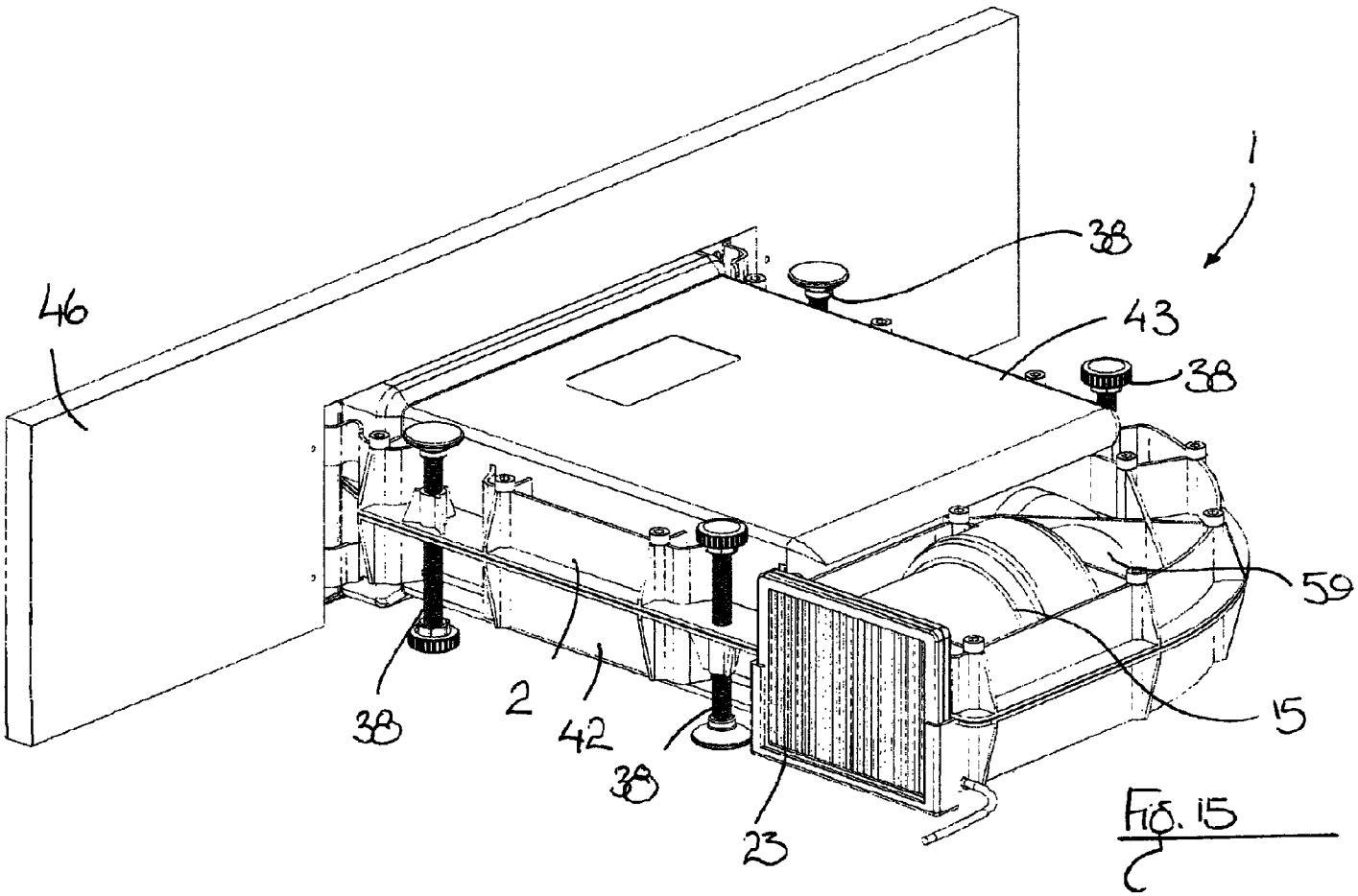
FIG. 15 is a rear perspective view from above and one side of the vacuum apparatus and kicker board of FIG. 14.

Internally, as shown particularly in FIGS. 2 to 4, the housing 2 defines a ribbed dustbag storage cradle 13 adjacent the front wall 7 and communicable with the inlet aperture 10 for receiving and holding a disposable dustbag 14 in the housing 2. The housing 2 further defines a motor chamber 15 located to the rear of the dustbag storage cradle 13 between the housing rear wall 6 and an internal wall 16 extending between the first and second side walls 4,5 respectively of the housing 2.

The motor chamber 15 houses first and second suction motors 17,18 respectively to suck air, dust and debris through the inlet aperture 10 in the front head section 9 and into the dustbag 14 in the storage cradle 13. The suction motors 17,18 are mounted side by side in a parallel arrangement within the motor chamber 15 and are partially separated by a flange 19 upstanding from the housing bottom wall 3. The suction motors 17,18 are in fluid communication with the dustbag 14 via first and second suction openings 20,21 respectively defined in the internal wall 16. The suction openings 20,21 are each fitted with a dirt filter 22 to prevent dirt and debris from entering the motor chamber and damaging the motors 17,18.

The rear wall 6 of the housing 2 is provided with first and second air outlet apertures 23,24 respectively to permit egress of air from the suction motors 17,18. The air outlet apertures 23,24 are each provided with an optional pollen filter 25.

The dustbag 14 in the storage cradle 13 is communicable with the air inlet aperture 10 via a front opening 26 defined in the housing front wall 7. More particularly, the front opening 26 is dimensioned and shaped to receive a rearwardly extending duct 27 on the front head section 9. Accordingly, the rearwardly extending duct 27 extends rearwards from the inlet aperture 10 into the storage cradle 13. The dustbag 14 is detachably mountable on the duct 27 to secure the dustbag 14 to the duct 27 in the storage cradle 13 in a conventional manner.

As indicated above, the front head section 9 is detachably mounted on the front wall 7 of the housing 2 to facilitate replacement of the dustbag 14 as required. More particularly, the front head section 9 is shaped and dimensioned to slot or fit into a complimentary front recess 28 at the front wall 7 to the front of the front opening 26. The front recess 28 is defined by first and second forwardly extending projections 29,30 respectively which are contiguous with their respective first and second housing side walls 4,5.

First and second side walls 31,32 of the front head section 9 are shaped and configured to be received between the first and second projections 29,30. The first and second projections 29,30 are provided with respective inwardly disposed faces 33,34 each provided with a pair of retractable lugs 35. The lugs 35 are retractable with a retraction button 36 on the second projection 30. The first and second side walls 31,32 of the front head section 9 are provided with pairs of laterally extending resilient lugs 36 positioned to ride over the retractable lugs 35 and hold the front head section in position in the front recess 28 on the housing 2. In order to remove the front head section 9 from the housing 2, the retractable lugs 35 are simply retracted by pressing the retracting button 36 on the second projection 30 to release the front head section 9 from the housing 2.

As indicated above, the vacuum apparatus 1 can be located in a kitchen in a suitably sized cavity in a kicker board or similar beneath kitchen cabinets and the like. In order to assist in locating and securing the vacuum apparatus 1 in-situ, the vacuum apparatus is provided with size adjustable feet 38 on the housing side walls 4,5. The adjustable feet 38 are made up of extendible and retractable screws 39 with plate-like heads 40 held in brackets 41 on the side walls 4,5. The screws 39 can be adjusted to extend from their respective brackets 41 until the heads 40 abut a surface such as a cabinet floor or a floor proper to hold the vacuum apparatus in position. Accordingly, the size adjustable feet 38 locate, stabilise and secure the housing 2 in-situ and assist in ensuring that the air inlet aperture 10 is level and located at ground or floor level to receive dust and debris.

As indicated above, in the present embodiment, the suction motors 17,18 are disposed directly to the rear of and in line with the front head section 9 on two parallel straight line axes defined by the air inlet aperture 10 and the first and second outlet apertures 23,24. The in line arrangement of the air inlet aperture and the outlet apertures 23,24 provides excellent suction force at the air inlet aperture 10 while the use of two small suction motors 17,18 in place of a larger single motor can facilitate a particularly low profile self-contained vacuum apparatus 1 where desired. However, as will be appreciated by those skilled in the art, and as described further below, a single suction motor 17,18 can also be used in the self-contained vacuum apparatus of the invention if desired.

When it is desired to remove dust or dirt from the floor surface, it is simply necessary to brush the dirt towards the inlet aperture 10 and then start the vacuum apparatus by pressing the on/off switch 12. The dirt is then sucked up into the vacuum apparatus 1 through the front head section 9 and the rearwardly extending duct 27 into the dustbag 14. When the dustbag 14 is full, it is a simple matter of pressing the retracting button 36 and gripping and pulling the hood 11 to withdraw the front head section 9 from the housing 2 and remove the dustbag 14 from the storage cradle 13 for emptying or replacement. As will be appreciated by those skilled in the art, in a bagless format, a re-useable container can be used in place of a dustbag 14 if desired.

FIGS. 6 to 15 show a second embodiment of the self-contained vacuum apparatus 1 of the invention in which the vacuum apparatus 1 is provided with a single suction motor 17 in place of the twin suction motors 17,18 and a single air outlet aperture 23 in place of the pair of air outlet apertures 23,24 of FIGS. 1 to 5. Moreover, as shall be explained more fully below, in the present embodiment, the single air outlet aperture 23 is off-set with respect to the air inlet aperture 10 i.e. are not located on a single axis as shown in FIGS. 1 to 5 so that that the vacuum apparatus 1 vents air through the air outlet aperture 23 from its side. Like numerals indicate like parts.

As shown in FIGS. 6 to 15, the self-contained vacuum apparatus 1 is generally made up of a housing 2 having a removeable front head section 9 with an air inlet aperture 10 at floor or ground level, a storage cradle 13 in the housing 2 for holding a dustbag 14, a motor chamber 15 to the rear of the storage cradle for housing a single motor 17 and a single air outlet aperture 23 positioned to vent to the side of the vacuum apparatus.

In the present embodiment, the housing 2 is made up of a bottom shell 42 and a detachable top shell 43 mounted on the bottom shell 42. The bottom shell 42 and the top shell 43 are shaped and contoured to house the storage cradle 13, the dustbag 14 and the motor chamber 15. A gasket seal 44 is disposed between the bottom shell 42 and the top shell 43 to seal the housing 2.

The housing 2 is further provided with a faceplate 45 mountable on a kicker board 46 (see FIG. 15) when the vacuum apparatus 1 is installed in a domestic kitchen for example. The kick switch 12 is located on the faceplate 45. The faceplate 45 is provided with a front head section opening 47 for receiving the front head section 9.

The front head section 9 is provided with a pivotable handle 48 at its top edge 49 inserting the front head section 9 in and removing the front head section 9 from the housing 2 through front head section opening 47. The pivotable handle 48 has a releasable latch and locking mechanism 50 to lock the handle in position in the housing 2. The latch and locking mechanism 50 is made up of a pair of sprung catches 51 on the top edge 49 of the front head section 9 adapted to engage in corresponding recesses 52 in the housing top shell 43. The sprung catches 51 are retracted by pulling on the pivotable handle 48 to pivot the handle 48 and release the catches 51 from the recesses 52.

In the present embodiment, the front head section 9 is integral with the storage cradle 13 so that the storage cradle 13 can be removed from the housing 2 through the front head section opening 47 in the faceplate 45 with the front head section 9.

The rearwardly extending duct 27 of FIGS. 1 to 5 is replaced by through bore 53 surrounded by a bore flange 54 defined in the front head section 9 in communication with the air inlet aperture 10. The air inlet aperture 10 is provided with a trough-like insert 58 located to rest on or abut a floor surface to assist in drawing dirt and debris into the inlet aperture 10.

A spring loaded dustbag 14 attachment mechanism 55 familiar to those skilled in the art is provided on the front head section 9 for attaching the dustbag 14 around the flange 54 at a collar 56 provided on the dustbag 14. The tray-like storage cradle 13 is also provided with a series of upstanding ribs 57 to facilitate flow of air through the housing 2.

As indicated above, a single suction motor 17 is mounted in the motor chamber 15 rearwardly of the storage cradle 13 In an analogous manner to the embodiment described in FIGS. 1 to 5, the suction motor 17 is in fluid communication with the storage cradle 13 and dustbag 14 via a (single) suction opening 20 defined between the bottom shell 42 and the top shell 43 of the housing 2. The suction opening 20 is fitted with a dirt filter 22. The suction opening 20 is located to the rear of the air inlet aperture 10 is a similar fashion to the embodiment described in FIGS. 1 to 5. However, in the present embodiment, bottom shell 42 and the top shell 43 of the housing 2 are shaped so that the motor chamber 15 is adapted to define an arcuate conduit 59 between suction opening 20 and the suction motor 17 so that the motor chamber 15 (and the suction motor 17) are oriented on an axis substantially perpendicular to the air inlet aperture 10 and the suction opening 20. As a result, the single air outlet aperture 23 is located in the first side wall 4 of the housing 2. The air outlet aperture 23 can be fitted with a pollen filter 25 as previously described.

Accordingly, in the present embodiment, the suction motor 17 is oriented substantially transversely with respect to the air inlet aperture 10 and the suction opening 20 at an angle of approximately 90° so that the air outlet aperture 23 is offset with respect to the air inlet aperture 10. Suction is therefore transversely applied to the dustbag 14 via the arcuate conduit 59 and the suction motor therefore exhausts through the air outlet aperture 2 at right angles to the direction of air flow through the dustbag 14.

As air is vented from the side wall 4 of the housing 2, the present embodiment serves to avoid undesirable pressure build up where space is at a premium e.g. where the depth of a cavity into which the vacuum apparatus 1 is to be inserted is limited and the air outlet apertures 23,24 in the rear wall 6 of the housing 2 of FIGS. 1 to 5 were to be located adjacent a rear wall or other structure resulting in a potentially undesirable build up of pressure in use.

It has been found that a motor with a rating of 15 kPA, a wattage of approximately 600 watts and an airflow of $1.4M^3$/minute is suitable for the apparatus described.

The embodiment of FIGS. 6 to 15 is operated in an analogous manner to that of FIGS. 1 to 5 e.g. in a domestic kitchen, the housing 2 is mounted under a cabinet or cupboard by removing a portion of the kicker board 46, inserting the housing 2 in the cavity behind the kicker board 46 and adjusting the adjustable feet 38 to properly locate and secure the housing 2 in the desired position. In the desired position, the air inlet aperture 10 should be level engage with the floor surface while the housing should be secured with the adjustable feet in such a manner that vibration is minimised in use. The dustbag 14 is positioned on the storage cradle 13 and is secured to the front head section 9 as previously described.

The on/off kicker switch 12 is connected to an electrical supply. If desired a releasable connector can be located between the kicker switch 12 and the electrical supply to further simplify installation and removal of the vacuum apparatus 1.

Dust or dirt which accumulates on the floor surface is simply brushed towards the region of the air inlet aperture 10 and the suction motor 17 is activated by operating the on/off kick switch 12. It is not necessary for the user to bend to operate the vacuum apparatus 1 nor is it necessary for the user to transport the vacuum apparatus 1 to dirt or debris. The dirt and dust is then sucked up into the vacuum apparatus 1 via the air inlet aperture 10, through the front head section 9 and the through bore 53 into the dustbag 14. When the dustbag 14 is full, the storage cradle 13 can be removed from the housing 2 by simply pulling on the pivotable release handle 48 to release the front head section 9 from the housing 2 to retract the storage cradle 13 from the housing 2. The dustbag 14 can then simply be replaced.

It will be appreciated by those skilled in the art that the conduit 59 can be oriented and shaped as required so that the air outlet aperture 23 can be positioned to vent or exhaust in any direction from the apparatus e.g. to the front (using a U-shaped conduit 59), rear, side, diagonally etc. as required.

As indicated above, the vacuum apparatus has a low profile ideally suited to domestic use beneath kitchen cabinets and the like and typically will have a height of approximately 110 mm, a width of approximately 315 mm at its front, a width of approximately 280 mm at its rear and a depth of approximately 390 mm.

The vacuum apparatus 1 of the invention, as with all vacuum apparatus, can be fitted with suitable seals such as gasket seals, U-channel seals and the like throughout as required to ensure effective vacuum creation and resultant suction by the motors 17,18.

The filters used in the vacuum apparatus can be of any suitable type such as HEPA filters, foam filters and cardboard filters.

As with the first embodiment of the invention, it will be appreciated that rather than having a dustbag 14, a bagless container system can be employed in the vacuum apparatus of the invention if desired.

Typically, the motors used in the vacuum apparatus of the invention will have a wattage from about 400 watt to about 600 watt although higher wattages can be used if required while the motors preferably have a maximum diameter of about 90 mm. A suitable motor for use in the vacuum apparatus of the invention is Model KBVM1110 available from Suzhou Kaibao Electric Company Ltd.

It will be appreciated that other on/off kicker switch mechanisms can be used e.g. IR motion sensor switches and the like. Other switch mechanisms that can be employed include magnetic and electronic switches. For example, a magnetic switch could be operated by a removeable ring located on a brush head containing a chip communicable with the switch.

The vacuum apparatus of the invention can be manufactured from any suitable materials such as plastics, metal and the like.

The invention is not limited to the embodiment described herein which may be modified or varied without departing from the scope of the invention.

The invention claimed is:

1. A self-contained vacuum apparatus comprising:

a housing having an air inlet aperture for receiving debris;

a storage in the housing communicable with the air inlet for storing received debris;

a suction motor communicable with the air inlet aperture for generating suction at the aperture to draw the debris into the storage, an air outlet aperture communicable with the suction motor to exhaust air from the vacuum apparatus, and an on/off switch for activating the vacuum apparatus, the housing being mountable in a cavity to locate the air inlet aperture adjacent a floor surface, wherein the air inlet aperture is formed as part of a front head section removeably mounted on the housing, the air inlet aperture being fluidly communicable with the storage through the front head section.

2. A self-contained vacuum apparatus as claimed in claim 1 wherein the storage comprises a storage cradle removeably mounted in the housing.

3. A self-contained vacuum apparatus as claimed in claim 2 wherein the storage further comprises a dustbag removeably mounted in the cradle.

4. A self-contained vacuum apparatus as claimed in claim 1 wherein the air inlet aperture is fluidly communicable with the storage through a bore in the front head section.

5. A self-contained vacuum apparatus as claimed in claim 1 further comprising a face plate mountable between the front head section and the housing.

6. A self-contained vacuum apparatus as claimed in claim 5 wherein the front head section comprises a handle and a locking mechanism for reversibly locking the handle in situ.

7. A self-contained vacuum apparatus as claimed in claim 1 further comprising adjustable stabilisers on the housing for securing the vacuum apparatus in situ.

8. A self-contained vacuum apparatus as claimed in claim 1 further comprising a dirt filter mounted between the storage and the suction motor.

9. A self-contained vacuum apparatus as claimed in claim 1 wherein the air inlet aperture, the housing, the storage, the suction motor and the air outlet aperture are arranged to define a low profile vacuum apparatus.

10. A self-contained vacuum apparatus as claimed in claim 1 wherein the housing is mountable in a cavity beneath a cabinet.

11. A self-contained vacuum apparatus as claimed in claim 10 wherein the cabinet is a kitchen cabinet.

12. A self-contained vacuum apparatus as claimed in claim 1 wherein the on/off switch comprises a kicker switch.

13. A self-contained vacuum apparatus as claimed in claim 1 wherein the air outlet aperture is disposed linearly from air the inlet aperture so that the air inlet aperture and the air outlet aperture are in a linear relationship.

* * * * *